US008231019B2

(12) United States Patent
Battegazzore

(10) Patent No.: US 8,231,019 B2
(45) Date of Patent: Jul. 31, 2012

(54) BOTTLE CLOSURE

(75) Inventor: Piero Battegazzore, Alessandria (IT)

(73) Assignee: Guala Closures, S.p.A., Alessandria AL (IT)

( * ) Notice: Subject to any disclaimer, the term of this patent is extended or adjusted under 35 U.S.C. 154(b) by 907 days.

(21) Appl. No.: 11/632,705

(22) PCT Filed: Dec. 23, 2004

(86) PCT No.: PCT/IB2004/004264

§ 371 (c)(1), (2), (4) Date: Mar. 25, 2008

(87) PCT Pub. No.: WO2006/011002

PCT Pub. Date: Feb. 2, 2006

(65) Prior Publication Data

US 2008/0264893 A1 Oct. 30, 2008

(30) Foreign Application Priority Data

Jul. 22, 2004 (IT) ..... MI2004A1485

(51) Int. Cl.
*B65D 41/34* (2006.01)

(52) U.S. Cl. ..... 215/253; 215/251

(58) Field of Classification Search ..... 215/227, 215/252, 276, 251, 250, 253, 21, 259.4, 259.3, 215/206; 206/459.5; 40/310, 311
See application file for complete search history.

(56) References Cited

U.S. PATENT DOCUMENTS 1,982,145 A * 11/1934 Shera ..... 220/257.1
(Continued)

FOREIGN PATENT DOCUMENTS

EP 1 254 059 B 4/2004
(Continued)

OTHER PUBLICATIONS

International Search Report for PCT/IB2004/004264 mailed Apr. 13, 2005.

*Primary Examiner* — Anthony Stashick
*Assistant Examiner* — Kevin Castillo
(74) *Attorney, Agent, or Firm* — Nixon & Vanderhye PC

(57) ABSTRACT

Closure for bottles, particularly for a bottle with a neck (2) provided with a thread (5), the said closure comprising an inner cap of plastics material, having an end wall (9) and a tubular skirt (10) connected to the rim of the said end wall and extending axially along the neck, the said tubular skirt (10) being provided with an internal thread (12) which engages with the said thread (5) provided on the neck, together with an outer cap (14) of sheet metal which covers the said inner cap and which is fixed to the neck of the bottle by fixing means (22), at least one circular weakening line (19) being provided in the said sheet metal outer cap (14), the said outer cap (14) having a tubular shape and being provided with an annular enlargement (24) extending radially outwards and axially over a specified distance with the formation of an inner annular channel (25) delimited by corresponding axial end stops (26, 27) and facing the tubular skirt (10) of the inner cap. The latter is provided with an annular thickening (28) extending radially and axially, the said thickening (28) being delimited by corresponding axial end stops (29, 30) and being force-fitted into the said channel (25).

14 Claims, 6 Drawing Sheets

U.S. PATENT DOCUMENTS

| | | | | | |
|---|---|---|---|---|---|
| 2,063,615 | A | * | 12/1936 | Merolle | 215/256 |
| 2,131,969 | A | * | 10/1938 | Podel | 215/323 |
| 2,326,480 | A | * | 8/1943 | Merolle | 215/256 |
| 3,348,718 | A | * | 10/1967 | Musy | 215/252 |
| 3,472,410 | A | * | 10/1969 | Turner | 215/206 |
| 3,664,536 | A | * | 5/1972 | Emery | 215/251 |
| 3,924,771 | A | * | 12/1975 | Cleff | 215/246 |
| 4,544,073 | A | * | 10/1985 | Willis | 215/246 |
| 6,050,436 | A | * | 4/2000 | Bennett et al. | 215/256 |
| 6,403,173 | B1 | | 6/2002 | Granger et al. | |

FOREIGN PATENT DOCUMENTS

| | | |
|---|---|---|
| FR | 1 517 037 A | 3/1968 |
| WO | 94/20237 | 9/1994 |

* cited by examiner

BOTTLE CLOSURE

This application is the US national phase of international application PCT/IB2004/004264 filed 23 Dec. 2004, which designated the U.S. and claimed priority of IT MI2004A001485 filed 22 Jul. 2004, the entire contents of each of which are hereby incorporated by reference.

The present invention relates to a closure for bottles, particularly for a bottle provided with an opening delimited by the free end of a neck which extends axially from the body of the bottle along a longitudinal axis (X-X) and which is provided with an outer surface having a thread positioned near the opening and with at least one annular stop on the neck of the bottle, positioned between the thread and the body of the bottle, the said closure comprising a inner cap of plastics material with an end wall transverse to the said longitudinal axis, a tubular skirt connected to the rim of the said end wall and extending axially along the said outer surface of the neck towards the said body of the bottle, the said tubular skirt being provided with an internal thread which engages with the said thread provided on the outer surface of the neck, and a outer cap of sheet metal which covers the said inner cap and which is fixed to the neck of the bottle by fixing means which engage with the said annular stop of the neck, at least one circular weakening line being provided in the said sheet metal outer cap, positioned axially immediately above the said means for fixing the outer cap to the neck of the bottle and being provided with an annular enlargement extending radially towards the outside of the outer cap and axially over a portion of predetermined length with the formation of an inner annular channel delimited by corresponding axial end stops and facing the tubular skirt of the inner cap.

Closures for bottles of the type specified above are known. The document WO 94/20237 illustrates an example of practical embodiment of such a closure, which however has the drawback of requiring a particularly high thickness of the skirt of the threaded inner cap element inserted into the metal outer cap, since its adhesion to the inner walls of the metal outer cap is achieved principally by a marked radial elastic deformation of the skirt and its subsequent release after its axial insertion into the tubular outer cap, to which it adheres by pressure.

This makes it difficult and uneconomical to provide a closure having the characteristics described in WO 94/20237 for use on bottles having standard mouths, with aperture diameters and thread sizes in accordance with UNI 9574, for example, because the high thickness of the skirt of the inner cap required to enable it to be press-fitted into the tubular outer cap would not be compatible with the dimensions of the intermediate spaces available between the thread and the metal outer cap. In order to provide a closure of the type specified above which is suitable for fitting on bottles with standard mouths, solutions have been proposed in which the thickness of the skirt of the inner cap is reduced as far as possible, while remaining compatible with the structural requirement of allowing the formation of an internal thread to engage with the external thread of the bottle neck, the sheet metal outer cap is made without any annular thickening with the formation of an internal channel, and the inner cap is joined to the tubular metal outer cap by the interposition of an adhesive. An example of a closure of the type indicated above, suitable for bottles with standard mouths, is illustrated in EP-A-1,254,059.

However, this closure has the fundamental drawback of not providing a secure and sufficiently strong joint between the plastics inner cap and the overlying metal outer cap, and therefore, especially at the time of initial opening in which a relatively high force has to be exerted to break the weakened securing area of the outer cap, the outer cap slides on the inner cap skirt, making it difficult to open the bottle.

Furthermore, the use of adhesive in the formation of the structure of the outer cap for bottles containing beverages is considered inadvisable in terms of hygiene and environmental protection.

Finally, the structure of the inner cap formed according to EP-A-1,254,059, which necessarily has a very thin skirt, does not provide satisfactory mechanical behaviour of the closure, because it is subject to possible breakage both during the axial fitting of the closure on to the bottle neck, at the time of capping, and subsequently in the course of unscrewing and screwing for closing the bottle.

The object of the present invention is essentially to provide a closure, particularly but not exclusively suitable for bottles with standard mouths, according to UNI 9574 for example, which is free of the drawbacks encountered in closures according to the prior art.

A further object of the invention is to provide a closure which, when in position on the bottle neck, imparts to this neck the typical shape of the neck of a wine bottle, with the presence of a significant annular rim projecting radially and located around the neck opening or immediately below it.

These objects are achieved by the closure according to the invention which is characterized according to claim 1 below.

The invention will now be described more fully with reference to some examples of its practical embodiment, provided solely for guidance and without restrictive intent, and illustrated in the attached drawings, in which.

Figure 1:
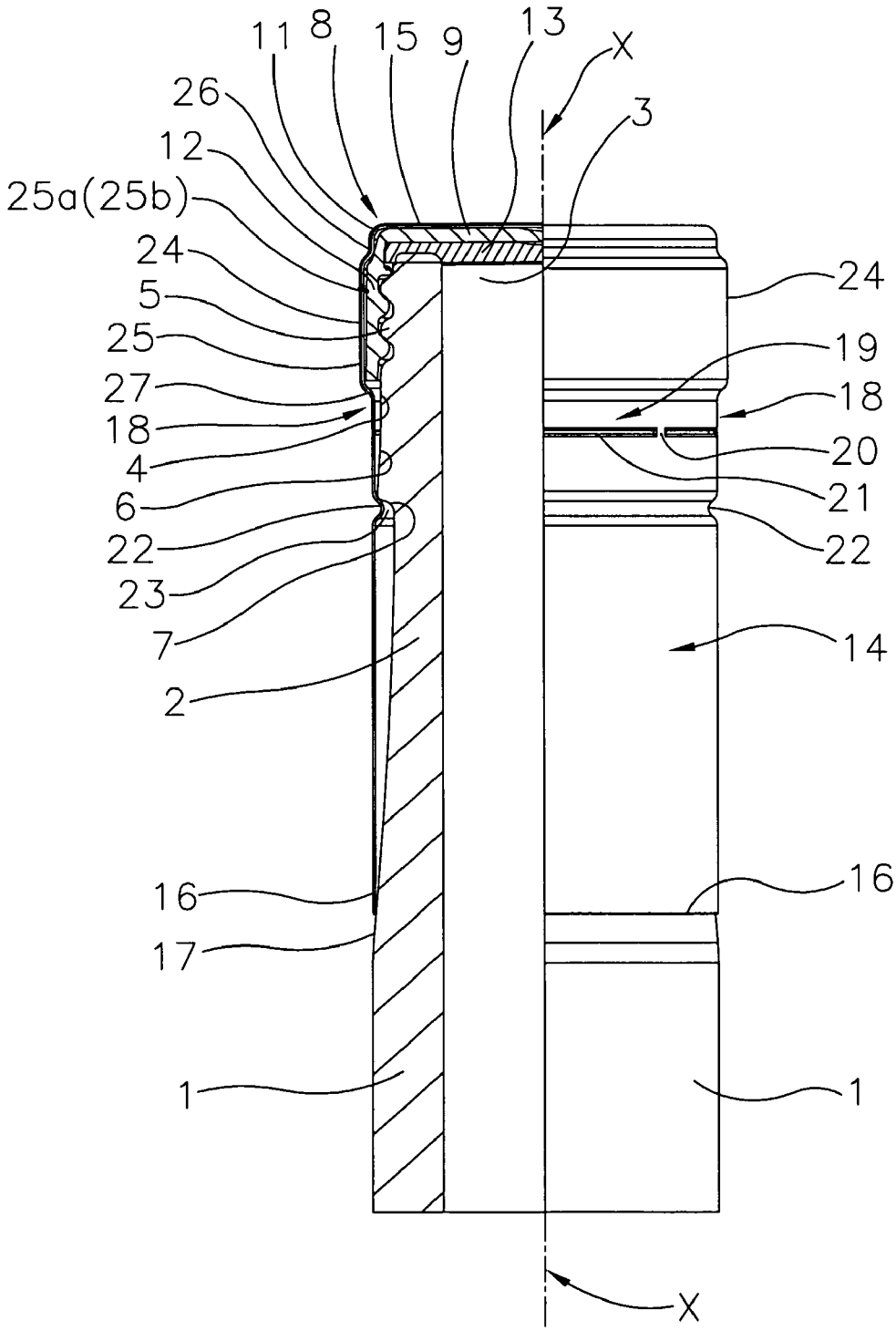
FIG. 1 shows a first embodiment of the closure according to the invention fitted on a bottle neck in the closed position, half in section and half in side view.
Figure 2:
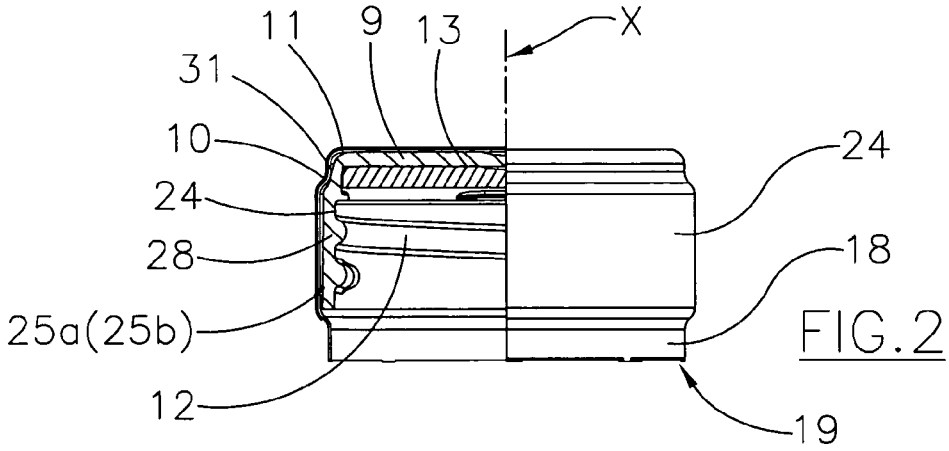
FIG. 2 shows the portion of the outer cap and inner cap of the closure of FIG. 1, separated from the bottle neck, half in section and half in side view.
Figure 3:
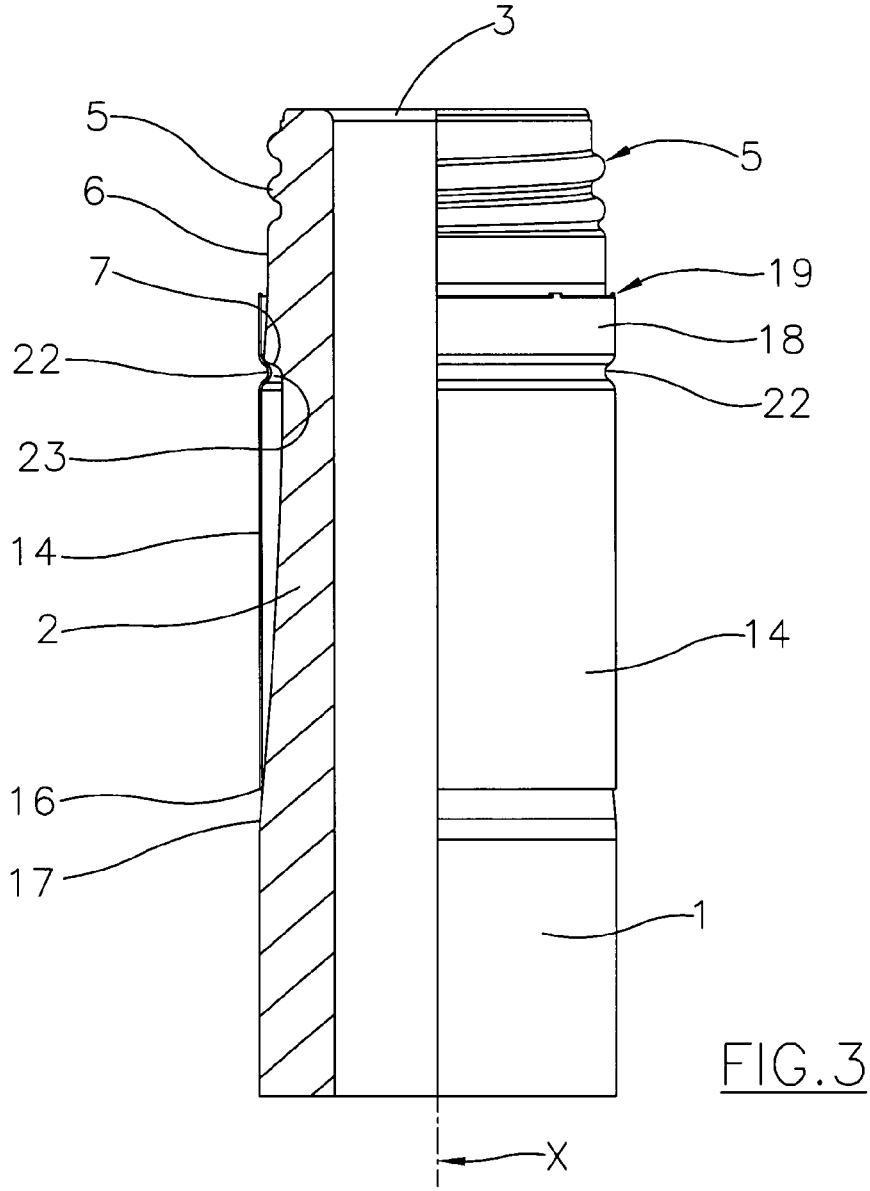
FIG. 3 shows the bottle neck with the attached tubular portion of the sheet metal outer cap of the closure of FIG. 1, half in section and half in side view.

With reference to the aforesaid figures, it will be observed that the number 1 indicates the part of the body of the bottle which is joined to the neck 2. The latter, particularly in the case of a conventional standard wine bottle, normally made from glass, is joined to the body of the bottle by a long and slender joining part and has an aperture 3, in the proximity of which a conventional thread 5 is formed on the outer surface 4. The whole mouth of the bottle is formed, for example, according to UNI 9574.

Below the thread 5, in the direction of the body 1 of the bottle, the neck 2 has a substantially cylindrical region 6 followed by an annular stop 7. With reference to the first embodiment of FIGS. 1 to 7, it will be seen that an inner cap 8 of plastics material is placed on the opening 3, this inner cap consisting of an end wall 9, transverse to the axis X-X of the bottle neck 2, and a tubular skirt 10 which extends axially from the rim 11 of the wall 9. A thread 12, engaged by screwing with the thread 5 of the neck, is formed on the inner surface of the tubular skirt 10. A conventional disc seal 13 is positioned against the end wall 9 and is interposed between the wall 9 and the free rim of the opening 3 to form a water-tight seal.

According to the invention, the closure comprises a tubular outer cap, indicated as a whole by 14, made from sheet metal and closed at the upper end 15, which is superimposed on the wall 9 of the inner cap and is open at the lower end 16 which is positioned substantially in the junction region 17 between the body 1 of the bottle and the neck 2.

In the region 18 which radially faces the substantially cylindrical region 6, the tubular outer cap 14 is provided with at least one conventional weakening line 19 consisting of breakable links 20 and circumferential cuts 21.

In the area below the weakening line 19, the said tubular outer cap 14, when fitted on the bottle neck, has an annular rib 22 which is inserted into the channel 23 below the stop 7 of the neck 3.

The rib 22 is formed in a conventional way by rolling when the outer cap 14 is fitted on the bottle neck, at the time of the capping of the bottle.

Figures 4, 5, 6, 7:
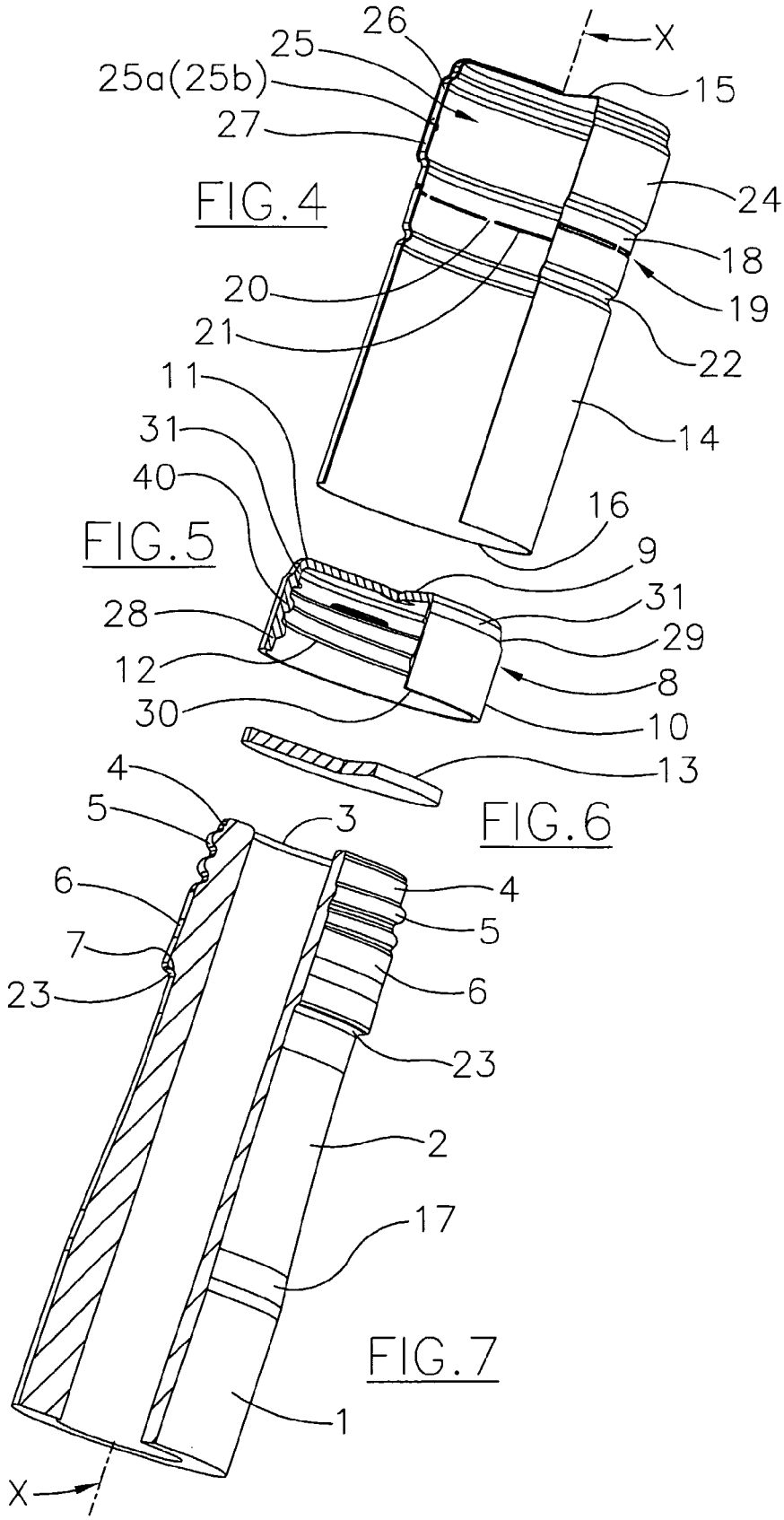
FIG. 4 shows a perspective view, in partial section, of the sheet metal outer cap only.
FIG. 5 shows a perspective view, in partial section, of the inner cap only, in a first embodiment.
FIG. 6 shows a perspective view, partially in section, of the seal for the inner cap of the preceding figure.
FIG. 7 shows a perspective view of the bottle neck, partially in longitudinal section.

In the region which faces the skirt 10 of the inner cap 8, as shown more clearly in FIG. 4, the outer cap 14 has an annular enlargement which extends radially with respect to the axis X-X for a specified distance and forms an inner channel 25 which extends axially between two axial end stops indicated by 26 and 27, separated by a specified distance.

The radial and axial dimensions of the annular channel 25, and the corresponding dimensions of the enlargement 24 which forms it, can be selected so as to give the bottle neck in the proximity of the opening the typical configuration of a bottle of fine wine.

Similarly, the skirt 10 of the inner cap 8 is provided with an annular thickening 28 which extends radially over a distance substantially matching the radial extension of the channel 25. The said annular thickening 28 also extends axially between two axial end stops 29 and 30 separated from each other by a distance which matches the distance between the axial stops 26 and 27 of the channel 25.

Consequently, the thickening 28 of the channel 10 of the inner cap can be housed in the channel 25 with a degree of force.

The insertion is carried out during the assembly of the closure, by applying radial elastic compression to the skirt 10 and rapidly inserting the inner cap axially into the tubular outer cap 14.

The axial insertion is facilitated by the presence of a taper 31 formed in the proximity of the rim 11 of the inner cap 8. As soon as it has passed the stop 27 of the channel 25, the skirt 10 can expand radially and its annular thickening 28 is inserted into the channel 25, occupying it with a specified degree of force which ensures its adhesion to the inner wall of the channel 25.

The axial stops 29 and 30 of the annular thickening 28 bear on the corresponding axial stops 26 and 27 of the channel 25, thus ensuring the stability of the axial joint between the outer cap 14 and the inner cap 8.

In an alternative method of fabrication, the inner cap 8 can be formed directly inside the outer cap 14 by injecting the plastics material in the molten state and by using suitable moulds.

The axial stops 29 and 30 of the thickening 28 and the corresponding axial stops 26 and 27 of the channel 25 form first means of interference which impede the axial movement of the said inner cap 8 and outer cap 14 with respect to each other.

The interference between the inner cap 8 and the sheet metal outer cap 14, designed to impede the movements of the outer and inner cap with respect to each other, is increased by the provision of second means of interference.

In a preferred embodiment, these means consist of a coat 25*a* of varnish or lacquer having a composition such that the facing surfaces are welded together when heat is applied.

If the inner cap 8 is formed by moulding directly inside the outer cap 14, the heat required for the welding is supplied by the said material which is in the molten state. The coat 25*a* of varnish or lacquer is deposited on the sheet metal of the outer cap 14 in such a way that it is located at least on the surface of the annular channel 24 facing the thickening 28 of the skirt 10 of the inner cap.

However, the coat 25*a* of varnish or lacquer can alternatively be deposited in such a way that it is located between the end wall 9 of the inner cap and the closed end wall 15 of the outer cap 14, thus causing these walls to be welded together, or, if the varnish or lacquer is also present on the surface of the annular channel 25, between all the outer surfaces of the inner cap and the opposing inner surface of the outer cap. In another possible variant, the coat 25*a* of varnish or lacquer, consisting of material suitable for welding, can be replaced with a coat 25*b* of what is known as opaque material, having a high coefficient of surface friction.

Figure 8:
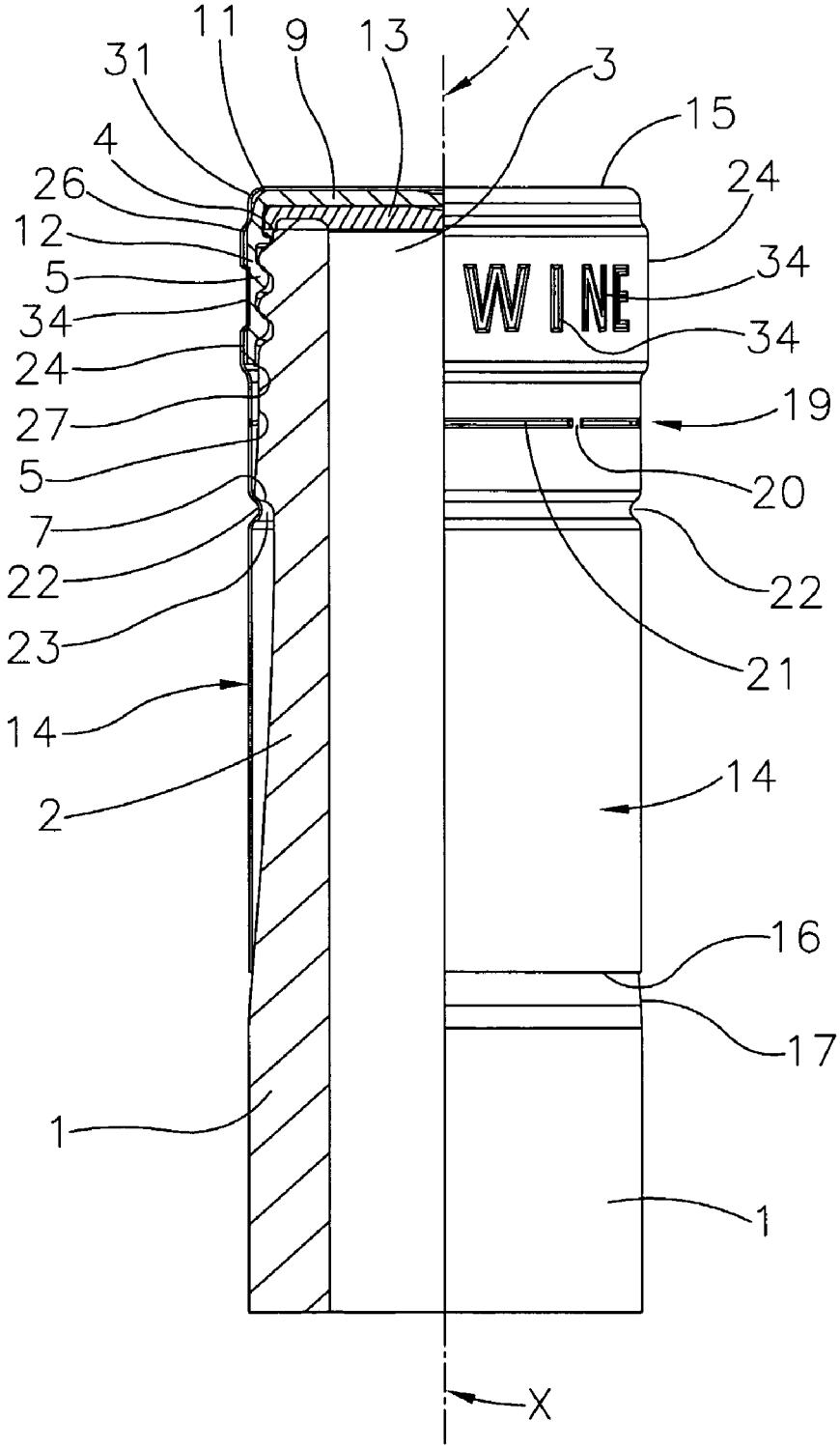
FIG. 8 shows a second embodiment of the closure according to the invention fitted on a bottle neck in the closed position, half in section and half in side view.
Figure 9:
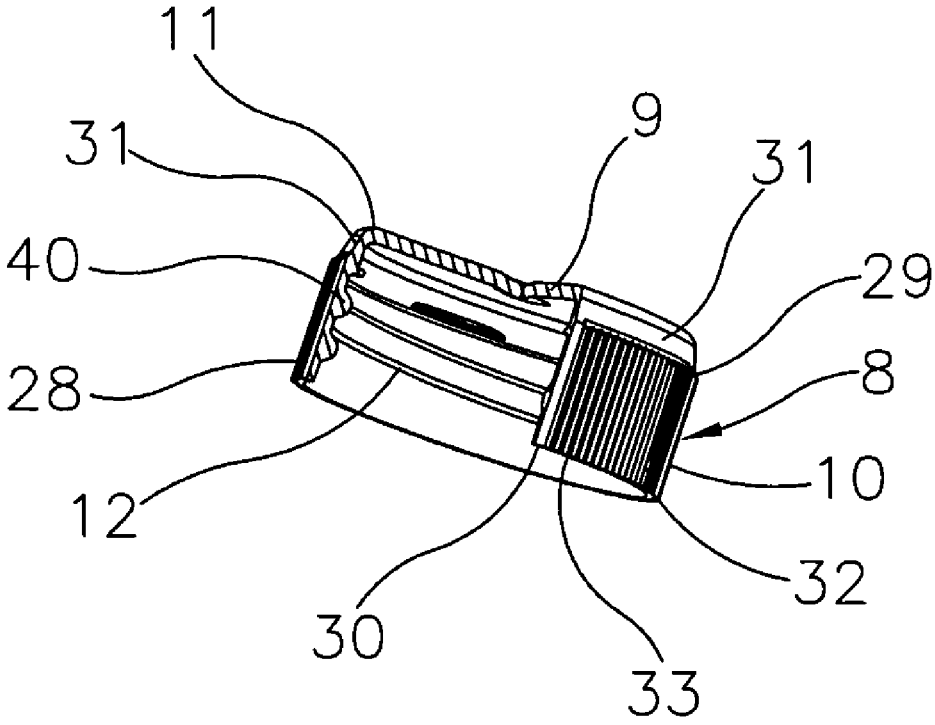
FIG. 9 shows a perspective view, partially in section, of the inner cap only, in a second embodiment, used in the closure of FIG. 8.

According to another aspect of the invention, illustrated in FIGS. 8 and 9, the second means of interference designed to impede the angular movement of the inner cap 8 and the sheet metal outer cap 14 with respect to each other are formed in a structural way by the provision of a plurality of axial ribs 32, alternating with axial grooves 33, formed on the outer surface of the thickening 28, and of axial projections indicated by 34 formed in the axial extension of the channel 25.

The projections 34 can be fitted into the grooves 33 and form a secure joint between the parts.

As shown in FIG. 8, the axial projections 34 can also consist of one or more axial portions of wording formed in relief towards the inside of the channel 25.

Alternatively, the projections 34 can also consist of edges of cuts passing through the thickness of the sheet metal of the outer cap, bent towards the inside of the channel 25.

Figure 10:
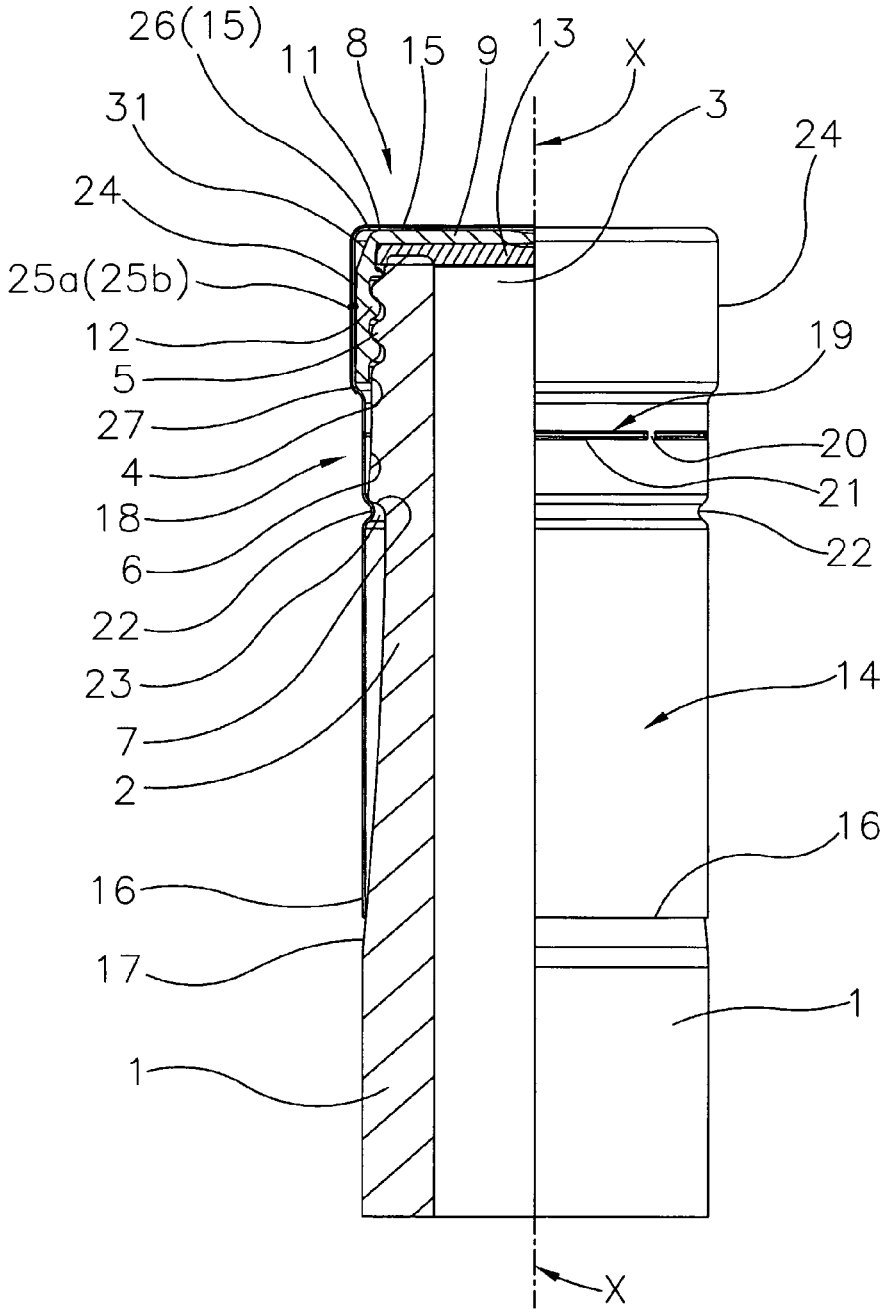
FIG. 10 shows a closure according to one of the embodiments of FIG. 1 or FIG. 8, with the modified closed upper end of the outer cap.

With reference to FIG. 10, it will be seen that, in one variant embodiment, the annular thickening 24 and therefore the corresponding annular channel 25 extend axially from the closed upper end of the outer cap 14.

In this variant embodiment, while all the characteristics described in relation to the other embodiments of the invention remain the same, it can be seen that the axial stop 26 of the channel 25 coincides with the said closed upper end 15 of the outer cap, and has the same functions as those described previously.

Because of the axial and angular interference between the inner cap 8 and the outer cap 14 formed as described above, there is no risk that the outer cap will slide angularly on the underlying inner cap when the closure is opened, and therefore the efficient breaking of the weakening line 19 and consequent opening of the closure is ensured.

The dimensions and materials may be chosen at will according to requirements, without departure from the scope of the invention as described above and as claimed below.

The invention claimed is:

1. Closure for bottles, particularly for a bottle provided with an opening delimited by the free end of a neck which extends axially from the body of the bottle along a longitudinal axis and which is provided with an outer surface having a thread positioned near the opening and with at least one annular stop on the neck of the bottle, positioned between the thread and the body of the bottle, the said closure comprising an inner cap of plastics material with an end wall transverse to the said longitudinal axis, a tubular skirt connected to the rim of the said end wall and extending axially along the said outer surface of the neck towards the said body of the bottle, the said tubular skirt being provided with an internal thread which engages with the said thread provided on the outer surface of the neck, and an outer cap of sheet metal which covers the said inner cap and which is fixed to the neck of the bottle by fixing means which engage with the said annular stop of the neck, at least one circular weakening line being provided in the said sheet metal outer cap, positioned axially immediately above the said means for fixing the outer cap to the neck of the bottle, the said outer cap having a tubular shape with an upper end in engagement with the end wall of the inner cap and being provided with an annular enlargement extending radially towards the outside of the outer cap and axially over a portion of predetermined length with the formation of an inner annular channel delimited by corresponding axial end stops extending inwardly from the outside of the outer cap and facing the tubular skirt of the inner cap, wherein the said tubular skirt of the inner cap is provided with an annular thickening extending radially and axially, the said thickening being delimited by corresponding axial end stops and being force-fitted into the said channel, whereby the annular enlargement of said outer cap is located adjacent to the bottle neck opening to provide the appearance of an enlarged neck of a wine bottle, wherein the channel extends axially over a distance at least substantially equal to the axial distance which the internal thread of the skirt of the inner cap extends.

2. Closure according to claim 1, wherein the said channel extends axially from the closed upper end of the sheet metal outer cap.

3. Closure according to claim 1, wherein the said thickening of the tubular skirt of the inner cap has a radial extension and an axial extension which substantially match the internal dimensions of the said channel formed by the said thickening of the outer cap.

4. Closure according to claim 1, wherein said closure comprises first means of interference designed to impede axial movements and second means of interference to impede angular movements of the sheet metal outer cap and the inner cap with respect to each other.

5. Closure according to claim 4, wherein the said first means of interference are designed to impede angular movements of the sheet metal outer cap and the inner cap with respect to each other are positioned at least between the said thickening and the inner surface of the said annular channel.

6. Closure according to claim 4, wherein the said first means of interference are designed to impede angular movements of the sheet metal outer cap and the inner cap with respect to each other are positioned at least between the closed upper end of the outer cap and the end wall of the inner cap.

7. Closure according to claim 4, wherein the said first and said second means of interference consist of a coat of varnish or lacquer consisting of a material which causes the facing surfaces to be welded together when heat is applied.

8. Closure according to claim 4, wherein the said first and said second means of interference consist of a coat of material having a high coefficient of surface friction.

9. Closure according to claim 4, wherein the said second means of interference are positioned between the said annular thickening of the skirt of the inner cap and the said annular channel of the outer cap , and comprise at least one plurality of axial ribs alternating with axial grooves formed in the said thickening of the tubular skirt of the inner cap.

10. Closure according to claim 9, wherein the said second means of interference include axial projections formed in the axial extension of the said channel of the outer cap and projecting radially towards the inside of the channel, the said axial projections being made to engage with the said axial grooves provided in the thickening of the skirt of the inner cap.

11. Closure according to claim 10, wherein the said second means of interference formed in the axial extension of the said channel of the outer cap and extending radially towards the inside of this channel include projections which form part of wording incised on the outside of the corresponding axial extension of the said enlargement of the outer cap.

12. Closure according to claim 11, wherein the said projections formed in the axial extension of the said channel are formed by bending towards the inside of the channel at least one of the edges of each of a number of cuts made through the thickness of the sheet metal of the outer cap.

13. Closure according to claim 4, wherein the said first means of interference which impede the axial movements of the said inner cap and the said metal outer cap with respect to each other consist of the axial end stops delimiting the said channel of the enlargement of the outer cap engaging with the corresponding axial end stops of the said thickening of the skirt of the inner cap.

14. Closure for bottles, particularly for a bottle provided with an opening delimited by the free end of a neck which extends axially from the body of the bottle along a longitudinal axis and which is provided with an outer surface having a thread positioned near the opening and with at least one annular stop on the neck of the bottle, positioned between the thread and the body of the bottle, the said closure comprising an inner cap of plastics material with an end wall transverse to the said longitudinal axis, a tubular skirt connected to the rim of the said end wall and extending axially along the said outer surface of the neck towards the said body of the bottle, the said tubular skirt being provided with an internal thread which engages with the said thread provided on the outer surface of the neck, and an outer cap of sheet metal which covers the said inner cap and which is fixed to the neck of the bottle by fixing means which engage with the said annular stop of the neck, at least one circular weakening line being provided in the said sheet metal outer cap, positioned axially immediately above the said means for fixing the outer cap to the neck of the bottle, the said outer cap having a tubular shape with an upper end disposed above the end wall of the inner cap and being welded thereto by a coat of varnish or lacquer disposed therebetween, said outer cap being provided with the end wall of the inner cap and being provided with an annular enlargement extending radially towards the outside of the outer cap and axially over a portion of predetermined length with the formation of an inner annular channel delimited by corresponding axial end stops extending inwardly from the outside of the outer cap and facing the tubular skirt of the inner cap, wherein the said tubular skirt of the inner cap is provided with an annular thickening extending radially and axially, the said thickening being delimited by corresponding axial end stops and being force-fitted into the said channel, whereby the annular enlargement of said outer cap is located adjacent to the bottle neck opening to provide the appearance of an enlarged neck of a wine bottle, wherein the channel extends axially over a distance at least substantially equal to the axial distance which the internal thread of the skirt of the inner cap extends.

* * * * *